US006434836B1

(12) United States Patent
Olivares

(10) Patent No.: US 6,434,836 B1
(45) Date of Patent: Aug. 20, 2002

(54) INTERCHANGEABLE BLADE CORDLESS ELECTRIC KNIFE

(76) Inventor: Hector Olivares, 6113 Brady Rd., Bancroft, WI (US) 54921

( * ) Notice: Subject to any disclaimer, the term of this patent is extended or adjusted under 35 U.S.C. 154(b) by 66 days.

(21) Appl. No.: 09/686,533

(22) Filed: Oct. 11, 2000

Related U.S. Application Data

(63) Continuation-in-part of application No. 09/435,170, filed on Nov. 5, 1999, now abandoned.

(51) Int. Cl.[7] ..... B26B 7/00
(52) U.S. Cl. ..... 30/277.4; 30/125; 30/DIG. 1
(58) Field of Search ..... 30/124, 125, 277.4, 30/DIG. 1, 272.1

(56) References Cited

U.S. PATENT DOCUMENTS 638,555 A * 12/1899 Burton ..... 30/125
3,043,996 A * 7/1962 Hartwig et al. ..... 30/34.05
3,303,563 A * 2/1967 Peterson ..... 30/277.4
3,307,259 A * 3/1967 Christensen ..... 30/277.4
4,711,030 A * 12/1987 Ruston, Sr. ..... 30/272.1
4,771,542 A * 9/1988 Beveridge ..... 30/277.4
4,891,884 A * 1/1990 Torbet ..... 30/277.4
5,058,273 A * 10/1991 Streger ..... 30/277.4
5,230,154 A * 7/1993 Decker et al. ..... 30/276
5,845,404 A * 12/1998 Jeffcoat ..... 30/125
5,911,481 A * 6/1999 Yost ..... 30/125

* cited by examiner

*Primary Examiner*—Hwei-Siu Payer
(74) *Attorney, Agent, or Firm*—John D. Gugliotta; Michael J. Corrigan

(57) ABSTRACT

The invention is an electric knife that runs on a battery or by use of a corded power converter. The handle housing has an electric reciprocating motor activated by a power button located on the handle of the knife. Different sizes and shapes of knife blades, dependent on the task, can be inserted into a locking slot in the front of the motorized head, and only released by a heavy-duty lock knife release button. The motorized head is powered directly by an electric motor located directly behind it in the handle.

4 Claims, 7 Drawing Sheets

INTERCHANGEABLE BLADE CORDLESS ELECTRIC KNIFE

RELATED APPLICATIONS

The present application is a Continuation in Part of U.S. Ser. No. 09/435,170, filed on Nov. 5, 1999 and herein abandoned.

BACKGROUND OF THE INVENTION

1. Field of the Invention

The present invention relates generally to electric knives and, more particularly, to a cordless electric knife having interchangeability of the various blades.

2. Description of the Related Art

In recent history, one improvement on conventional knife designs, the electric knife, has revolutionized the field by providing a knife having a reciprocating blade driven by an electric motor. Greatly reducing the amount of work required of the user, the electric knife turns monumental tasks such as turkey carving into a simple chore. Typically requiring the availability of an electric outlet, the use of these devices has been limited, however, to kitchens and other in-home applications.

A search of the prior art did not disclose any patents that read directly on the claims of the instant invention; however, the following references were considered related.

The following patents describe the design and function of a handle for an electric knife: U.S. Pat. No. 4,702,006 issued in the name of McCullough; U.S. Pat. No. D 298,601 issued in the name of Tsuji; and, U.S Pat. No. D 286,491 issued in the name of Levin.

The following patents disclose various ornamental designs of cordless electric knife handles: U.S Pat. No. D 312,192 issued in the name of Barrault; U.S Pat. No. D 306,813 issued in the name of Naft et al.; and U.S Pat. No. D 286,969 issued in the name of McCloskey.

U.S Pat. No. 5,230,154 issued in the name of Decker et al. describes a modular power-driven rotary knife able to accommodate different tasks.

U.S Pat. No. 4,891,884 issued in the name of Torbet discloses a cordless hand-held automatic bladed kitchen appliance.

U.S Pat. No. D 207,767 issued in the name of Bremshay et al. describes an ornamental design for a power-operated carving knife.

While some features of providing an electric knife having a reciprocating blade that is driven by a rechargeable battery driven power supply adjustable may be incorporated into this invention as well as in other related references, other elements in combination are different enough as to make the combination distinguished over these related references.

SUMMARY OF THE INVENTION

Therefore, it is an object of the invention to indicate a device of the type disclosed above which avoids the disadvantages inherent in the state of the art. In particular, it is an object of the present invention to provide an improved electric knife having interchangeability of the various blades, in combination with the in-handle storage feature to provide safety as well as convenience.

Briefly described according to one embodiment of the present invention, an electric knife having a reciprocating blade that is driven by a rechargeable battery driven power supply. This lightweight, portable design, opens the doors to a variety of uses that are otherwise impossible with conventional cord powered models. Especially handy for fishermen and other outdoor users, the knife includes a variety of use specific blades such as filleting blades, utility blades and carving blades that allow the user to perform a multitude of tasks with ease and precision.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
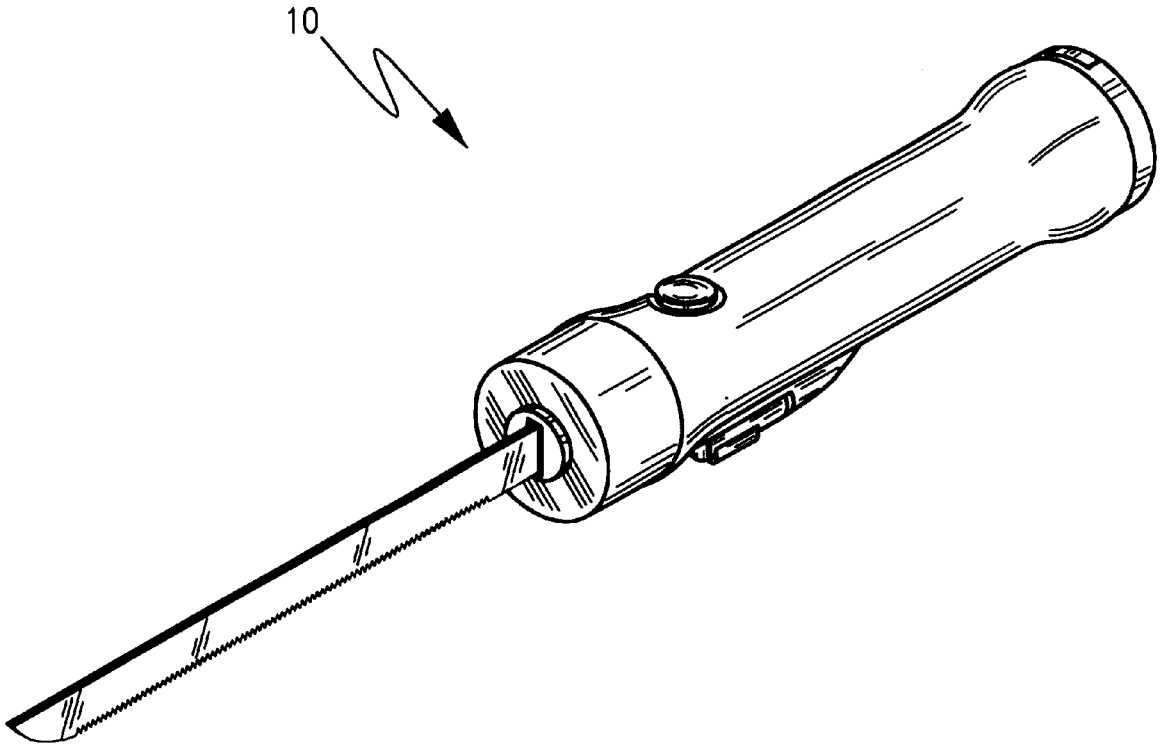
FIG. 1 is an elevated front perspective view of an Interchangeable Blade Cordless Electric Knife, according to the preferred embodiment of the present invention.

Referring now to FIG. 1, an Interchangeable Blade Cordless Electric Knife 10 shown, according to the present invention, wherein a plurality of interchangeable blades are disposed within the handle for storage. Device 10 is for use by the sportsman in the field for cutting and serrating fish, fowl, and game. A rechargeable battery is also disposed within a the handle for supplying power to a small electric motor. A sportsman can easily carry the device in their jacket, pants pocket, vest, or conveniently carry it in a tackle box.

Figure 2:
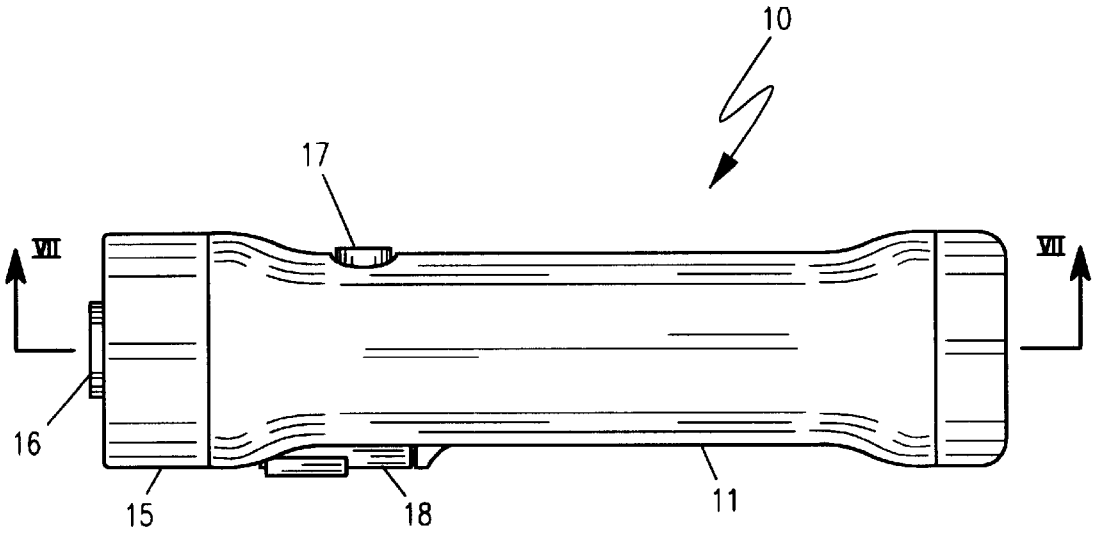
FIG. 2 is a side view of an Interchangeable Blade Cordless Electric Knife, according to the preferred embodiment of the present invention.

Referring now to FIG. 2, shown is a side view of an Interchangeable Blade Cordless Electric Knife 10 displaying the location of the important features of the device. Located at the front of the device is a motorized head 15 for providing a base for the Blade Receiving Slot/Locking Mechanism 16 is located for receiving blade 22 (not shown). Motorized head 15 is connected to a handle 11 which also serves as the housing for storing the blades 22 and battery 21 (not shown). Handle 11 is generally an elongated hollow cylinder flared outward at one end and having a sidewall at that end. Handle 11 and the housing for motorized head 15 may be constructed from plastic or metal. The other end is connected to motorized head 15 as described above. Located directly behind motorized head 15 on the top of the exterior sidewall of handle 11 is a power switch 17 for controlling the flow of electrical current to motor 15*a* (not shown). Located directly behind motorized head 15 on the bottom of the exterior sidewall of handle 11 is a knife blade release button 18 for releasing a knife blade 22 from Blade Receiving Slot/Locking Mechanism 16.

Figure 3:
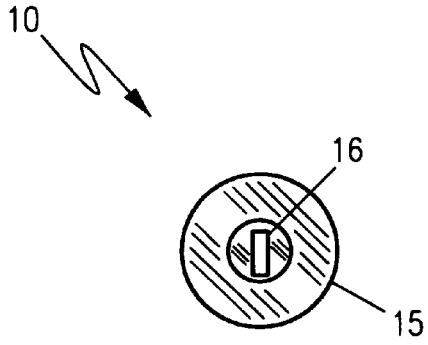
FIG. 3 is a front view of an Interchangeable Blade Cordless Electric Knife, according to the preferred embodiment of the present invention.

FIG. 3 shows a front view of an Interchangeable Blade Cordless Electric Knife 10 where blades 22 may be inserted into Blade Receiving Slot/Locking Mechanism 16. Blade Receiving Slot/Locking Mechanism 16 is typical of such mechanisms commonly found in electric kitchen knives. Such mechanisms will securely grip the knife blades until released by pushing a button.

Figure 5:
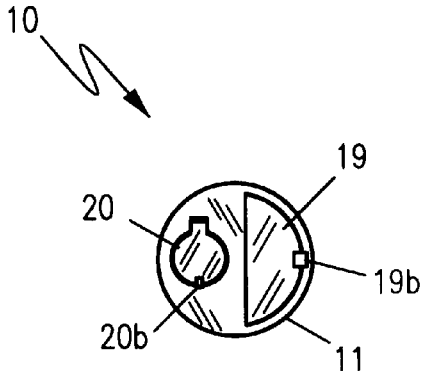
FIG. 5 is a rear view of an Interchangeable Blade Cordless Electric Knife, according to the preferred embodiment of the present invention.
Figure 4:
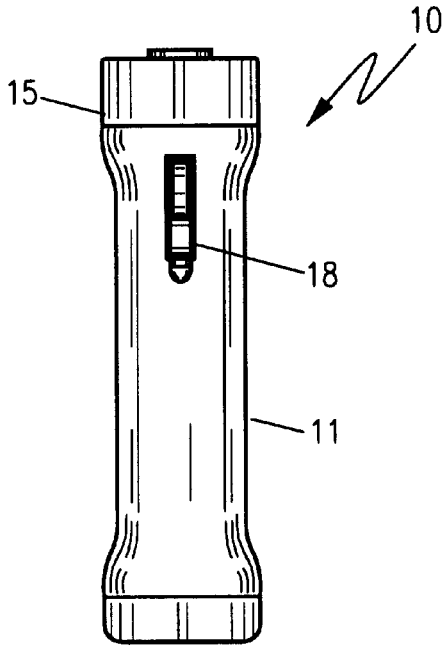
FIG. 4 is a bottom view of an Interchangeable Blade Cordless Electric Knife, according to the preferred embodiment of the present invention.
Figure 6:
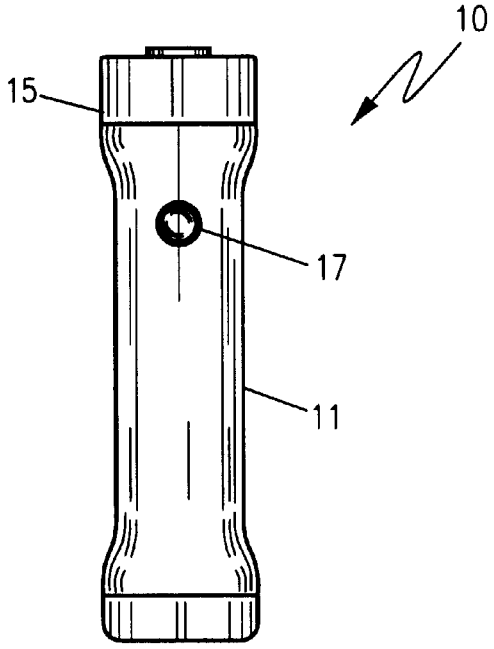
FIG. 6 is a top view of an Interchangeable Blade Cordless Electric Knife, according to the preferred embodiment of the present invention.

FIG. 4 is a bottom view of an Interchangeable Blade Cordless Electric Knife 10, showing a detailed view of the location of knife blade release button 18. FIG. 5 shows a rear view of device 10 and the location of battery compartment cover 20 and blade compartment cover 19. Battery compartment cover 20 is held shut by a spring loaded battery compartment latch 20*b*. Likewise, blade compartment cover 19 is held shut by a spring loaded blade compartment cover latch 19*b*. FIG. 6 shows a top view of device 10 showing the location of power switch 17 on the top of the exterior sidewall of handle 11.

Figure 7:
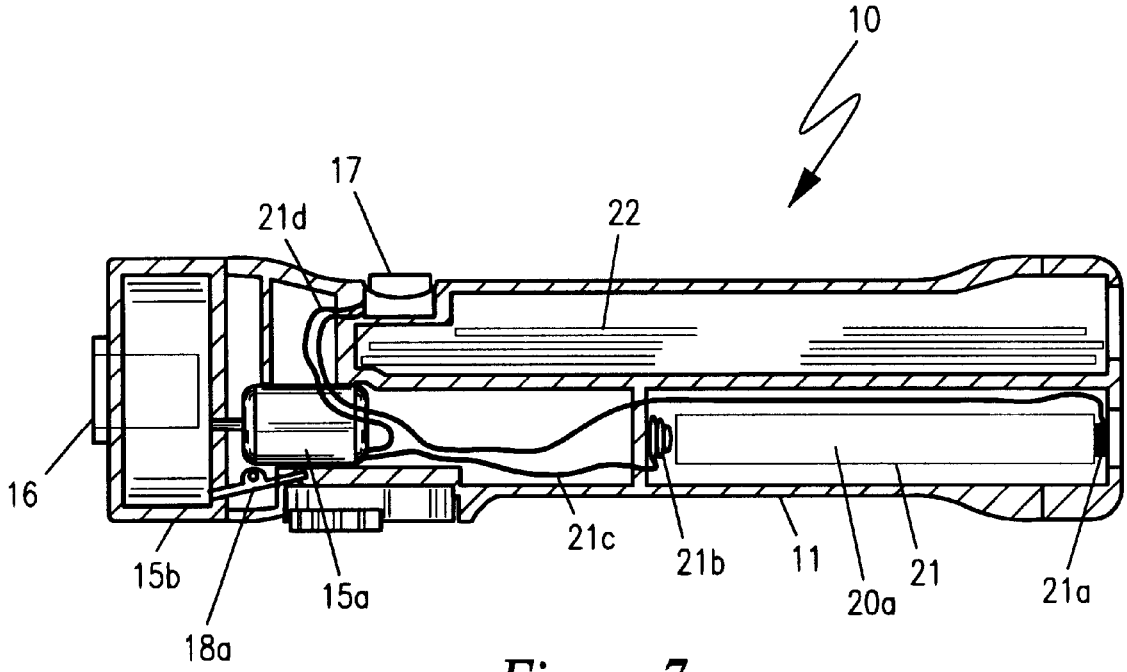
FIG. 7 is a top cutaway view of an Interchangeable Blade Cordless Electric Knife taken along line VII—VII of FIG. 2, according to the preferred embodiment of the present invention.

Referring now to FIG. 7, a cutaway top view of device 10 is shown taken along line VII—VII of FIG. 2 along the elongated longitudinal axis of handle 11. Gear Box 15*b* is disposed within motorized head 15. Gear Box 15*b* is driven by electric motor 15*a* and converts the rotational energy of electric motor 15*a* to a reciprocating back and forth motion in the Blade Receiving Slot/Locking Mechanism 16 for driving the cutting blades 22. Blade Receiving Slot/Locking Mechanism 16 is located in the center of motorized head 15. A linkage 18*a* connects Blade Receiving Slot/Locking Mechanism 16 to blade release button 18. Electric motor is supplied power via switched power wire 21*d* linked via power switch 17 from the positive battery contact 21*a*. The negative pole of electric motor 15*a* is connected to the negative battery contact 21*b* via ground wire 21*c*. Positive battery contact 21*a* is disposed within battery compartment 20*a* located on the interior of handle 11 on the inside of battery compartment cover 20. The negative battery contact 21*b* is located to the front end of battery compartment 20*a*. Battery 21 is placed within battery compartment 20*a* secured by battery compartment cover 20. Battery 21 is a rechargeable type battery that is typical of modern rechargeable tools and devices being an elongated cylinder with a positive pole on one end and a negative pole on the other. Such batteries are typically charged on a battery charger that sits on a counter type and is plugged into conventional household power outlets. Located above battery compartment 20*a* is cutting blade compartment 19*a*, an elongated cavity within handle 11, for storing a plurality of cutting blades 22 that can be inserted into Blade Receiving Slot/Locking Mechanism 16.

Figure 8:
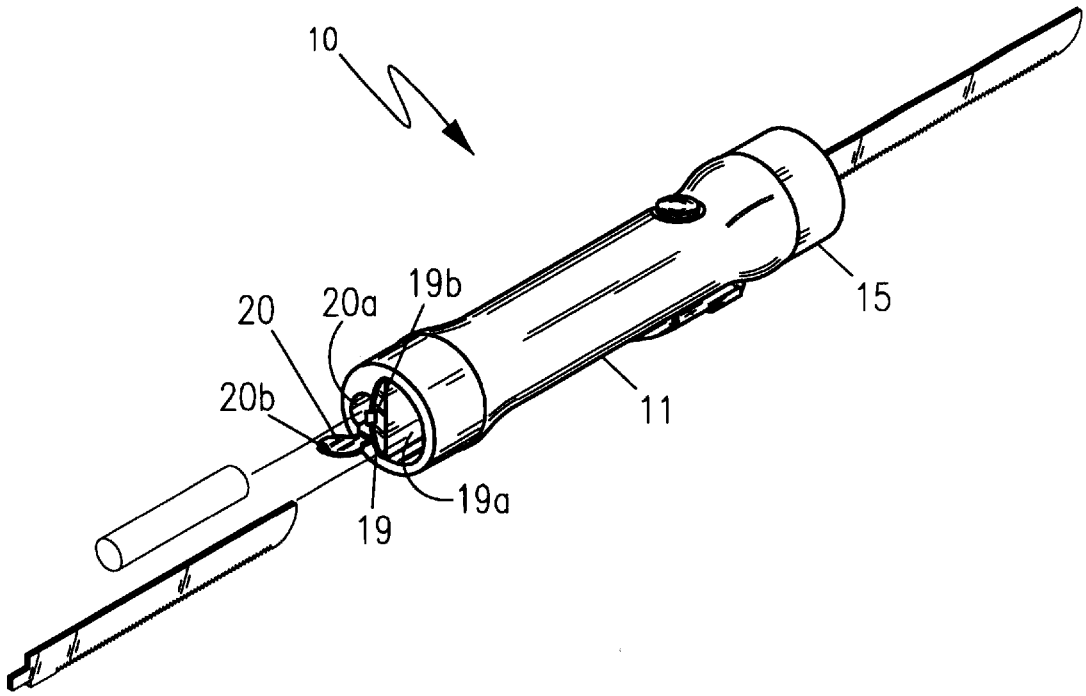
FIG. 8 is an elevated rear exploded perspective view of an Interchangeable Blade Cordless Electric Knife, according to the preferred embodiment of the present invention.

FIG. 8 shows an elevated exploded rear view of a device 10 showing how battery 21 is inserted into battery compartment 20*a*. Battery compartment cover 20 is shown in the open configuration. Battery compartment cover latch 20*b* is seen on the inner surface of cover 20. Battery compartment cover latch 20*b* is spring biased so that when closed it engages a notch in the sidewall of handle 11. Blade compartment cover 19 is also seen in the open configuration with blade compartment latch 19*b* seen on the inner surface. Blade compartment latch 19*b* is spring loaded and is designed to engage a notch in the sidewall of handle 11 when blade compartment cover 19 is in the closed configuration. A plurality of blades 22 can also be seen outside of handle 11.

Figure 9:
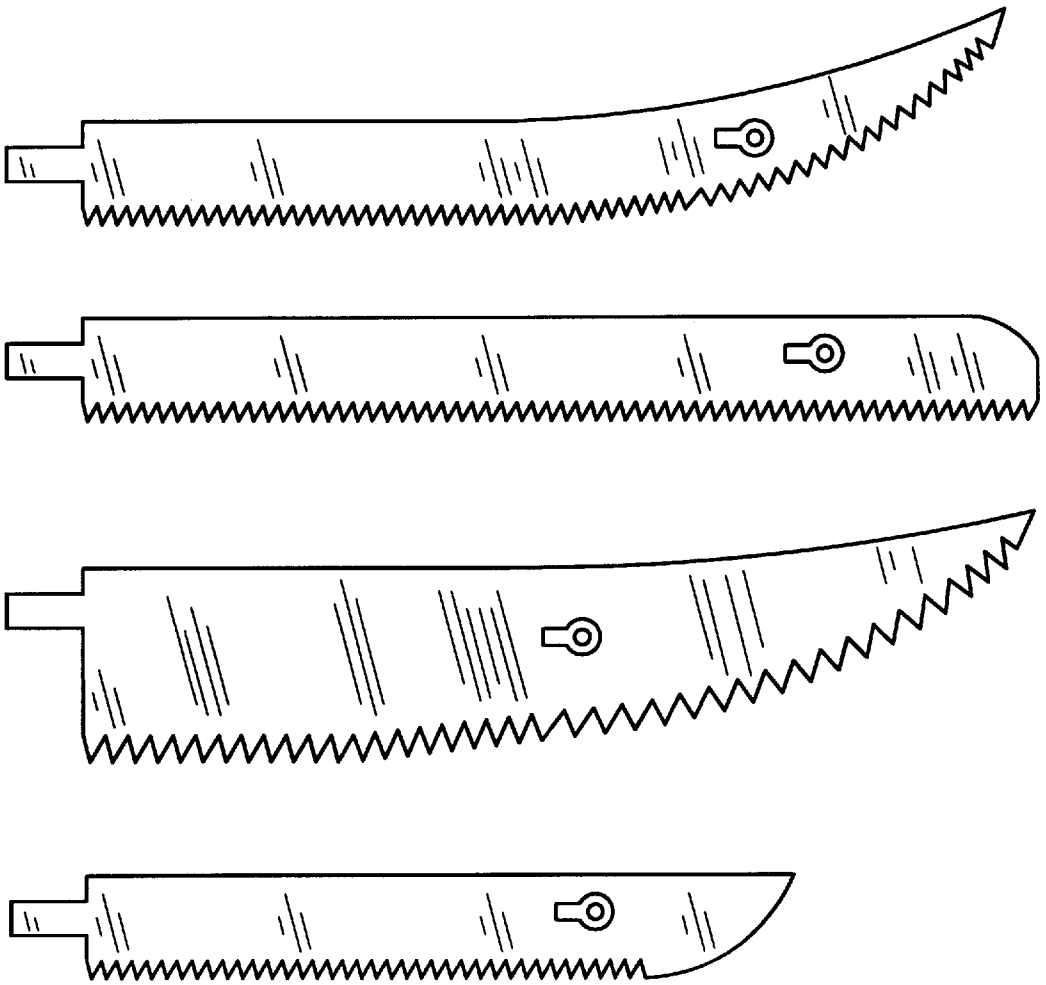
FIG. 9 is a side view of the various cutting blades for use with an Interchangeable Blade Cordless Electric Knife, according to the preferred embodiment of the present invention.

FIG. 9 shows a side view of a plurality of interchangeable blades 22, including a 7½" stainless steel fillet blade, a 7½" carving blade, and a small stainless steel knife. These blades are given as examples only and no way imply any limitation of the blades that could be used with device 10. Blades 22 are a pair of stainless steel blades placed next to each other and connected via a tab on one blades and a slot on the other. In this fashion, the blades are free to slide against each other providing a cutting motion when the power is turned on.

Figure 10A:
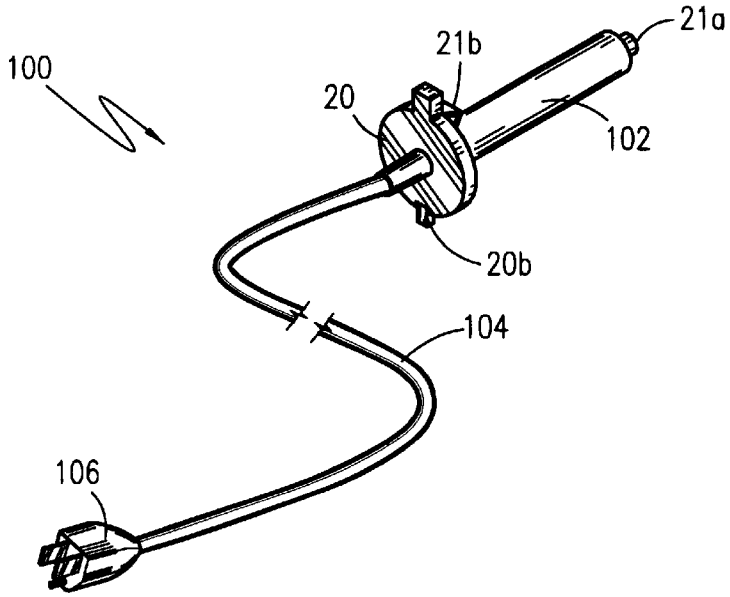
FIG. 10*a* is a perspective view of an alternating current cord adapter for use with the present invention.

Referring now to FIG. 10*a*, an alternating current power adapter 100 is shown for use with the present invention. Anticipated as replacing battery 21 and battery compartment cover 20, the adapter 100 is formed of a generally cylindrical housing 102 having the overall size and dimensions of the battery 21 that is being replaced. A positive contact 21*a* is provided at the distal end of the housing, and a battery compartment cover 20 is integrally molded into proximal end. Similarly, a spring loaded latch 20*b* is also provided such that when the housing 102 is inserted into the battery compartment of the handle housing, the positive contact 21*a* engages in firm mechanical and electrical contact with the ground wire 21*c*. At the same time, as the cover 20 mechanically attaches to the handle housing such that the spring loaded latch 20*b* engages, the negative contact 21*b* engages in firm electrical contact with the motor 15*a* and completes the electrical circuit. In this embodiment, the housing 102 retains an alternating to direct voltage converter that is anticipated to convert household, 110 VAC analog current to a digital voltage sufficient to power the motor 15*a*. A power cord 104 terminates at a distal end with an otherwise conventional plug 106, and is in electrical communication with the A/C converter at its proximal end.

Figure 10B:
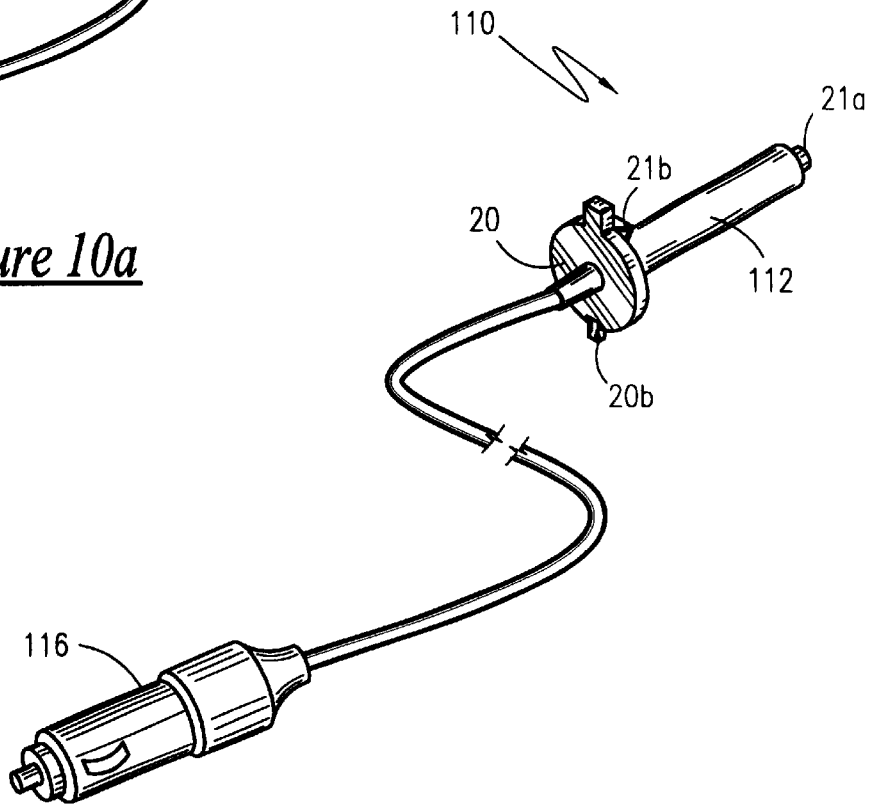
FIG. 10*b* is a perspective view of a direct current cord adapter for use with the present invention.

Finally, in FIG. 10*b*, a direct current power adapter 110 is shown for use with the present invention. Anticipated as replacing battery 21 and battery compartment cover 20, the adapter 110 is formed of a generally cylindrical housing 112 having the overall size and dimensions of the battery 21 that is being replaced. A positive contact 21*a* is provided at the distal end of the housing, and a battery compartment cover 20 is integrally molded into proximal end. Similarly, a spring loaded latch 20*b* is also provided such that when the housing 112 is inserted into the battery compartment of the handle housing, the positive contact 21*a* engages in firm mechanical and electrical contact with the ground wire 21*c*. At the same time, as the cover 20 mechanically attaches to the handle housing such that the spring loaded latch 20*b* engages, the negative contact 21*b* engages in firm electrical contact with the motor 15*a* and completes the electrical circuit. In this embodiment, the housing 112 retains an direct current voltage converter that is anticipated to convert household various voltages of direct current to a fixed voltage sufficient to power the motor 15*a*. A power cord 104 terminates at a distal end with an otherwise conventional vehicle plug adapter 116 for inserting into an otherwise convention vehicle cigarette lighter, and is in electrical communication with the current converter at its proximal end.

2. Operation of the Preferred Embodiment

To use the present invention, one inserts a pair of blades into the slot in the front of the motorized head. The slot is designed to lock the blades into the motorized and mechanically connect the blades to the electric motor. A plurality of blades of different shape are stored in the interior of the handle. A small door with a locking tab will allow a user access the blades. A power switch on the handle energizes the motor with electrical power from the battery. One simply pushes the power switch to energize the device. The device can be used to cut or fillet fish, fowl, or game. When one is done using the device, the power is switched off and the blades removed from the motorized head by pushing a release button on the bottom of the handle. The blades can now be cleaned and stored with the other blades. The battery may also be removed and recharged by putting it in the included counter top recharger powered by household current. The battery is accessed by opening a small door with a locking tab covering the battery compartment.

As designed, a device embodying the teachings of the present invention is easily applied. The foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. An electric knife comprising:

a handle having an internal cavity containing an electric motor in mechanical communication with blade receiving means;

a rechargeable battery disposed within said handle for supplying power to said electric motor;

a motorized head for providing a base for the blade receiving means, and a plurality of interchangeable blade elements, each said blade element capable of attaching, in a removable manner, to said blade receiving means;

a direct current power adapter converter for replacing said rechargeable battery within said handle, wherein said direct current power adapter comprises:

a generally cylindrical housing having a proximal end and a distal end disposable within said handle, said housing having the overall size and dimensions of said rechargeable battery;

a battery compartment cover integrally molded into said proximal end, said battery compartment cover having a spring loaded latch provided such that when said housing is inserted into a battery compartment within said handle, a firm mechanical contact is made with said handle and a firm electrical contact is made with said motorized head; and a direct current voltage converter for converting various voltages of direct current to a fixed voltage, said direct current voltage converter housed within said generally cylindrical housing;

a power cord having a vehicle plug adapter in electrical communication with said direct current voltage converter.

2. An electric knife comprising:

a handle having an internal cavity containing an electric motor in mechanical communication with blade receiving means;

a rechargeable battery removably disposed within said handle for supplying power to said electric motor;

a motorized head for providing a base for the blade receiving means, and a plurality of interchangeable blade elements, each said blade element capable of attaching, in a removable manner, to said blade receiving means; and an alternating current power adapter for replacing said rechargeable battery within said handle, wherein said alternating current power adapter comprises:

a generally cylindrical housing having a proximal end and a distal end disposable within said handle, said housing having the overall size and dimensions of said rechargeable battery;

a battery compartment cover integrally molded into said proximal end, said battery compartment cover having a spring loaded latch provided such that when said housing is inserted into a battery compartment within said handle, a firm mechanical contact is made with said handle and a firm electrical contact is made with said motorized head; and an alternating to direct voltage converter housed within said generally cylindrical housing;

a power cord having a plug in electrical communication with said alternating to direct voltage converter.

3. The electric knife of claim 2, wherein said handle further comprises:

a blade receiving slot, said blade receiving slot for accepting and storing any said blade elements not being attached to said blade receiving means; and a locking mechanism, said locking mechanism for securely gripping any said blade elements within said blade receiving slot until released.

4. The electric knife of claim 2, wherein said plurality of interchangeable blade elements comprises:

a 7½" stainless steel fillet blade;

a 7½" carving blade;

a 7" saw blade; and a utility blade.

* * * * *